US005410971A

United States Patent [19]

Golden et al.

[11] Patent Number: 5,410,971

[45] Date of Patent: May 2, 1995

[54] ADJUSTABLE WORK STATION FOR THE HANDICAPPED

[75] Inventors: Jo-Ann Golden, Lake Worth; Angelo Squatrito, Juno Beach; Thomas J. Brown, Wellington; Lawrence J. Yates, Lake Worth; Kenneth Elfman, Boynton Beach, all of Fla.

[73] Assignee: Jeff Industries, Inc., Hypoluxo, Fla.

[21] Appl. No.: 961,226

[22] Filed: Oct. 15, 1992

[51] Int. Cl.[6] ..... A47F 5/12

[52] U.S. Cl. ..... 108/6; 108/1

[58] Field of Search ..... 108/7, 2, 1, 9, 10, 108/147; 298/372.1, 404, 407, 157

[56] References Cited

U.S. PATENT DOCUMENTS

| | | | |
|---|---|---|---|
| 1,956,546 | 4/1934 | Froelich | 108/7 X |
| 3,079,726 | 3/1963 | May | 108/8 X |
| 4,350,098 | 9/1982 | Shirono et al. | 108/8 X |
| 4,558,648 | 12/1985 | Franklin et al. | 108/147 |
| 5,131,333 | 7/1992 | Karasawa et al. | 108/7 |
| 5,197,393 | 3/1993 | Yeakle | 108/7 X |

FOREIGN PATENT DOCUMENTS

| | | | |
|---|---|---|---|
| 594174 | 2/1934 | Germany | 108/7 |

OTHER PUBLICATIONS

Disabled Desk by Rol-Fol Table, Inc., Van Nuys, Calif., "An Innovative Idea from Rol-Fol Table! It's New . . . An Important Concept Whose Time is Now!".

*Primary Examiner*—Jose V. Chen

*Attorney, Agent, or Firm*—Quarles & Brady

[57] ABSTRACT

A work station for the handicapped includes work surface structure, support structure, and structure for urging the work surface structure upward relative to said support structure. Engagement structure is provided for securing the work surface structure in a plurality of positions relative to the support structure. Release structure is provided for disengaging the engagement structure to permit repositioning of the work surface structure. The release structure is preferably a grip bar positioned substantially at the front of the work surface structure to facilitate operation by the handicapped.

5 Claims, 4 Drawing Sheets

ADJUSTABLE WORK STATION FOR THE HANDICAPPED

BACKGROUND OF THE INVENTION

This invention relates generally to work stations, and more particularly to work stations for the handicapped.

DESCRIPTION OF THE PRIOR ART

Work stations such as desks, drawing tables, and computer tables are not readily adaptable for use by the handicapped. A handicapped person may require a work surface at a particular height for different activities, such as reading, writing, drawing, or computer utilization. The nature of the handicap may require different desk heights for different parts of the same activity. Prior work stations are adjustable, but very difficultly so for the handicapped, who may have impaired eyesight, motor control, strength, or use of the hands or legs.

SUMMARY OF THE INVENTION

It is an object of the invention to provide a work station which is readily adjustable by persons with handicaps.

It is another object of the invention to provide a work station for the handicapped which can be utilized for a variety of different activities.

It is still another object of the invention to provide a work station for the handicapped that can be utilized and adjusted by persons having different handicaps.

These and other objects are provided by a work station having work surface structure pivotally mounted to support structure. Biasing structure is provided to urge the work surface structure upward. Engagement structure is provided to secure the work surface structure at a desired location.

Release structure is provided to disengage the engagement structure and allow the work surface structure to move upward. The release structure preferably includes a grip bar positioned beneath the work surface structure where it is easily manipulated by the handicapped.

BRIEF DESCRIPTION OF THE DRAWINGS

There are shown in the drawings embodiments which are presently preferred it being understood, however, that the invention is not limited to the precise arrangements and instrumentalities shown, wherein.

DETAILED DESCRIPTION OF THE PREFERRED EMBODIMENTS

Figure 1:
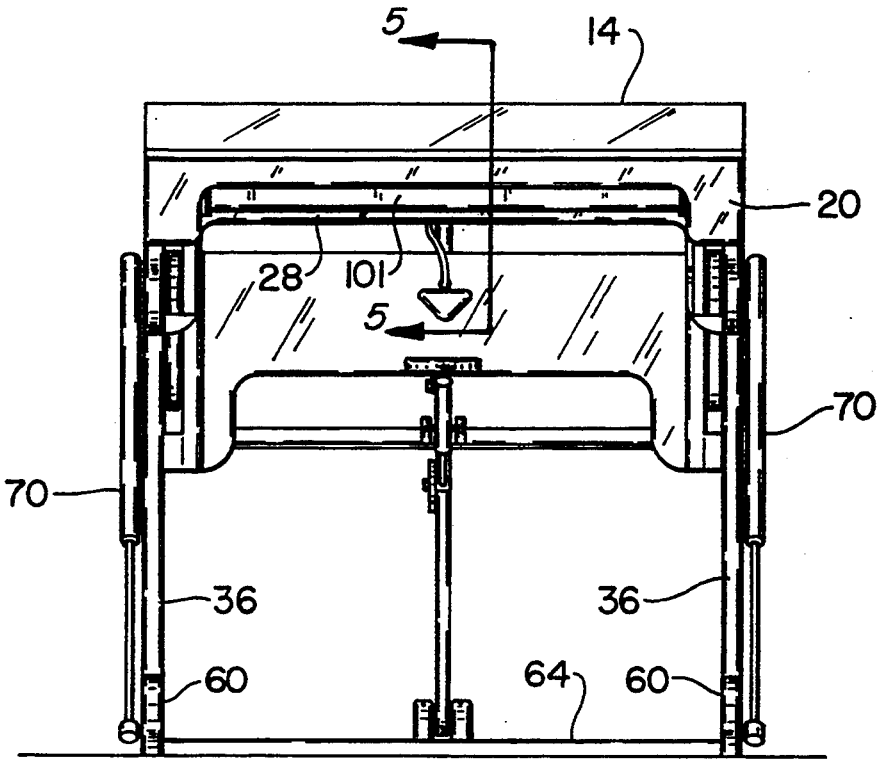
FIG. 1 is a front elevation of an adjustable work station for the handicapped according to the invention.
Figure 2:
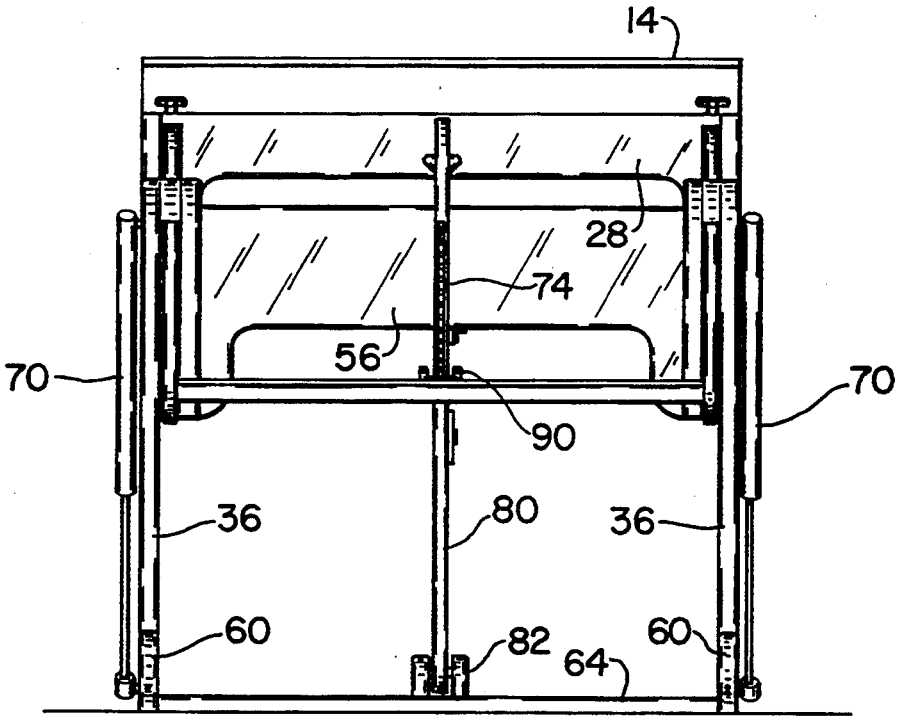
FIG. 2 is a rear elevation.

A preferred adjustable work station for the handicapped is shown in the drawings. The work station includes work surface structure 10 that is pivotally connected to support structure 12. Biasing structure is provided and adapted to urge the work surface structure upward. Engagement structure retains the work surface structure at a desired location against the urging of the biasing structure. Release structure is provided at or near the front of the work surface structure to permit the release of the engagement structure for positioning the work surface structure at alternative heights.

The work surface structure can take a variety of forms depending on the intended use of the work station. In the depicted embodiment, a desk top 14 is provided and pivotally mounted to other portions of the work surface structure by hinge structure to provide an adjustable writing surface. Alternatively, the desk top 14 could be replaced by a drawing table, a computer stand for the keyboard of a computer, a book stand for reading, or various other surfaces and structures for particular jobs and crafts. The intended use of the work station and the handicap of the anticipated user will dictate the form of the work surface structure. Detachable table tops and the like are preferably provided to permit substitution as necessary.

The work surface structure 10 can further comprise a front member 20, side members 23, 24, and a back member 28. Alternative designs and structure for the work surface structure 10 are also possible.

Pivot arms 32 are preferably provided at each lateral side of the work surface structure 10 and are pivotally mounted to the work surface structure 10 about pivot pins 34 or other suitable structure. The pivot arms 32 are also pivotally mounted to the support structure. In the currently preferred embodiment the support structure comprises upstanding support posts 36 at each lateral side of the work station. The pivot arms 32 are pivotally mounted to the support posts 36 as by pivot pins 40. Openings 44 can be provided in the support posts 36 to receive the pivot arms 32. Lower pivot arms 48 extend from the support posts 36 to the work surface structure 10 and can be pivotally mounted at each respective end thereof by pivot pins 50, 52.

Rigidity and stability for the structure can be provided through adequate bracing and supports. A cross-brace 56 can be connected between upper portions of the support posts 36. Base members 60 can be provided to stabilize the support posts 36, and a lower cross-brace 64 can be connected between the base members 60 to provide additional rigidity. The base members are preferably at least 29" apart to permit ready access by users confined to wheelchairs. A back brace 66 can be connected between rear portions of the pivot arms 32.

Biasing structure is provided to urge the work surface structure 10 upward. The biasing structure can be selected from any component suitable for this purpose, including springs, elastic bands, fluid cylinders, counterweights and the like. In the presently preferred embodiment, gas cylinders 70 are provided at each lateral side of the work station and connected between the base members 60 and the pivot arms 32.

The engagement structure is preferably provided as latch structure adapted to secure the work surface structure in a desired location. Other engagement structure is also possible. The latch structure can be selected from a variety of known latching or engagement structures, as it is only necessary that the structure secure the work surface structure against pivoting at any of a plurality of desired locations. In a presently preferred embodiment, the latch structure comprises a latch plate 74 with a plurality of recesses 78 along a rear-most edge thereof. The latch plate 74 can be positioned on a latch post 80. The latch post 80 can be pivotally mounted to the lower cross member 64, as at supports 82. A latch bar 86 can be mounted to the cross member 66, as at supports 90.

Biasing structure such as a gas cylinder 84, which can be connected between the support brace 56 and the latch post 80, is provided to urge the latch plate 74 into engagement with the latch bar 86. Alternative biasing structures, such as a hinge spring attached to the base and bottom of the latch post, is also possible. The recesses 78 in the latch plate 74 provide several points of engagement with the latch bar 86, and thus several pivotal positions of the pivot arms 32 and corresponding pivotal positions of the work surface structure 10.

The work surface structure can be pivoted downwardly against the biasing of the gas cylinders 70 by placing a slight pressure on the work surface structure 10. The gas cylinders 70 in the present embodiment preferably have a pressure rating of about 3 lbs. each, so that little downward force is necessary to lower the work surface structure. The gas spring moment should be selected to just exceed the weight moment of the work surface structure so that only a small force is necessary to overcome the gas springs or other biasing and lower the work surface structure. The force necessary to lower the desk should be no more than about 25 lbs., and most preferably less than 20lbs., in order to permit most handicapped persons to readily lower the desk. The gas spring moment can be altered by adjusting the angle or location at which at which the gas springs are mounted relative to the work surface structure and the support structure. Gas springs will typically lose force with decreasing temperature and increasing age, and so adjustments for these factors should be made during sizing.

Downward movement of the work surface structure 10 will pivot the rear portions of the pivot arms 32 upward, such that the latch bar 86 will travel up the latch plate 74 into one of the upper recesses 78. The range of movement of the work surface structure 10 is defined by the engagement of the pivot arms 32 and 48 to portions of the work surface structure, and by the extended and retracted lengths of the gas springs.

Release structure is provided to disengage the latch plate 74 from the latch bar 86. A release cable 98 or other suitable connecting member extends from the latch post 80 to a manual release such as the grip bar 100. The grip bar 100 is positioned at or near the work surface structure so that it can be easily manipulated by the user. A pull cord can be provided to assist those users who are unable to grasp the grip bar 100. The pull cord can be operated with the teeth, if necessary. The lateral dimension of the grip bar 100 is preferably at least one-half the lateral width of the work surface structure, and most preferably substantially equal to the lateral width, to facilitate grasping by the handicapped.

Figure 5:
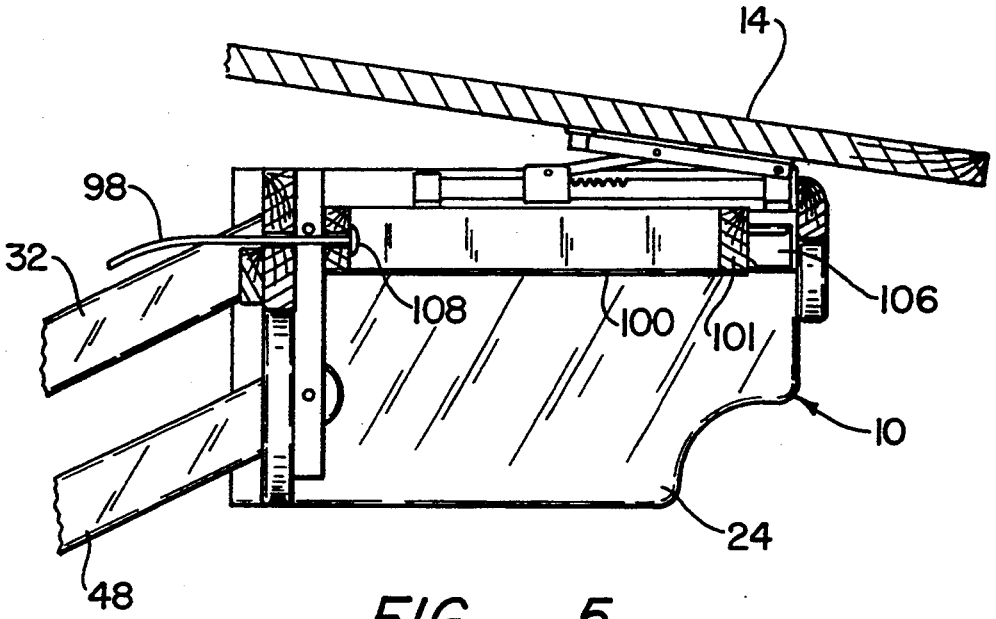
FIG. 5 is a cross-section taken along line 5—5 in FIG. 1, in a first mode of operation.

The grip bar 100 can be rectangular with a front member 101, side members 102-103, and a rear member 104. The side members 102-103 can be mounted to inside surfaces of the side members 23, 24 by suitable structure such as rollers (not shown) and guide rails 106 (FIG. 5). The latch cable 98 can be secured to the grip bar 100 by suitable structure such as the fastening pin 108 (FIG. 5).

The grip bar 100 is constructed and positioned in the work surface structure 10 such that at least the front member 101 can be easily reached for manipulation by the user. The front member 101 is preferably positioned at least partly beneath the lower edge of the front member 20 of the work surface structure, so that the user may easily grasp the grip bar 100 and move it forward.

Figure 3:
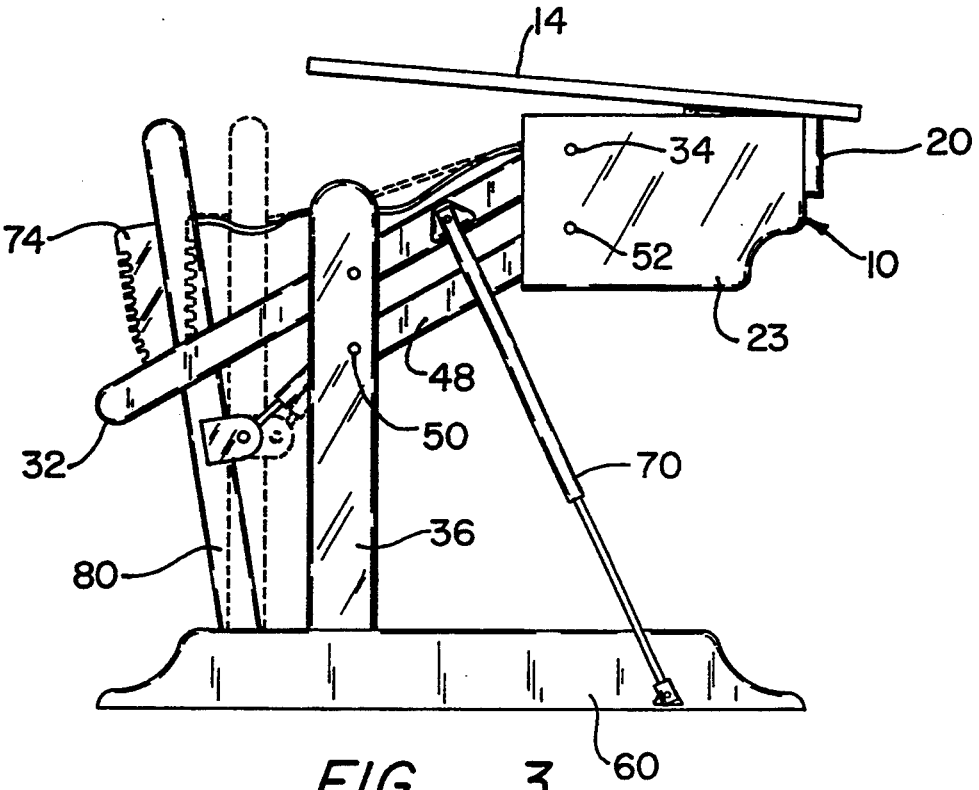
FIG. 3 is a left side elevation, partially in phantom.
Figure 4:
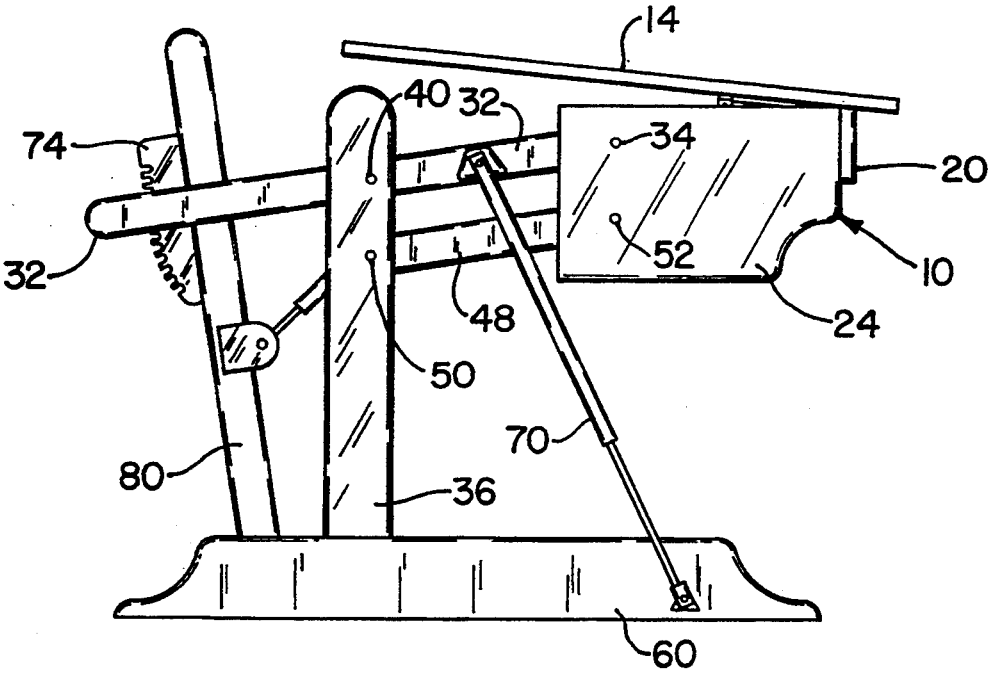
FIG. 4 is a left side elevation, in an alternative position.

Forward movement of the grip bar 100 tenses the latch cable 98 and pivots the latch post 80 toward the front of the work station (phantom lines in FIG. 3), such that the latch plate 74 is moved out of engagement with latch bar 86. The work surface structure 10 is then free to pivot upwardly under the biasing of the gas cylinders 70. The work surface structure 10 can either be allowed to pivot upwardly, or can be pressed gently downward to the desired location. The grip bar 100 is then released, where upon the biasing cylinder 84 will urge the latch post 80 and latch plate 74 into engagement with the latch bar 86. The respective recess 78 of the latch plate 74 will engage the latch bar 86 to retain the work surface structure 10 in the desired location.

Figure 6:
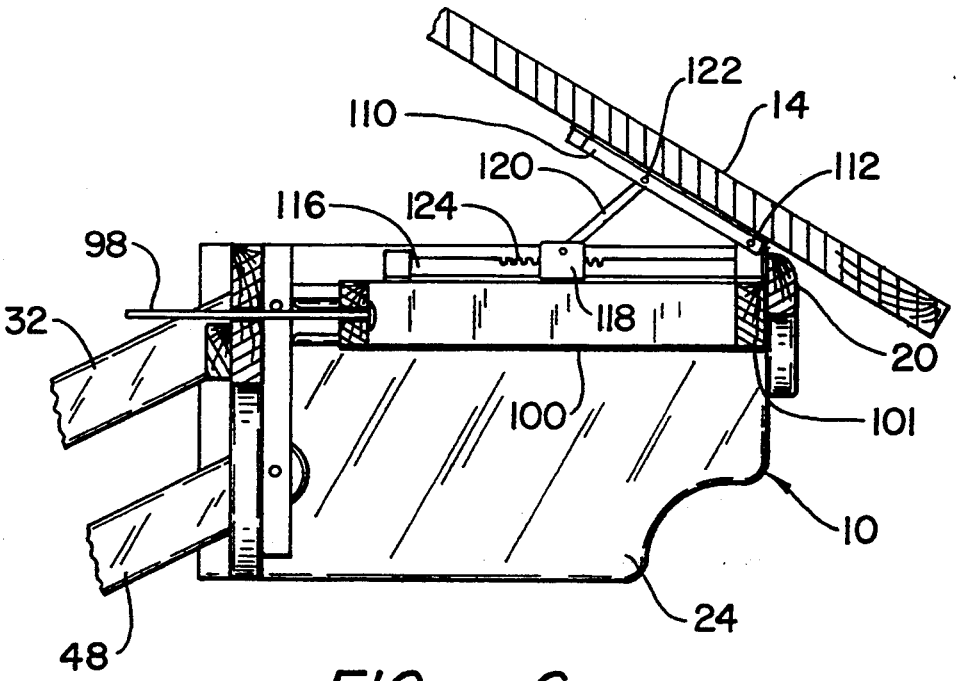
FIG. 6 is the cross-section of FIG. 5, and in a second mode of operation.
Figure 7:
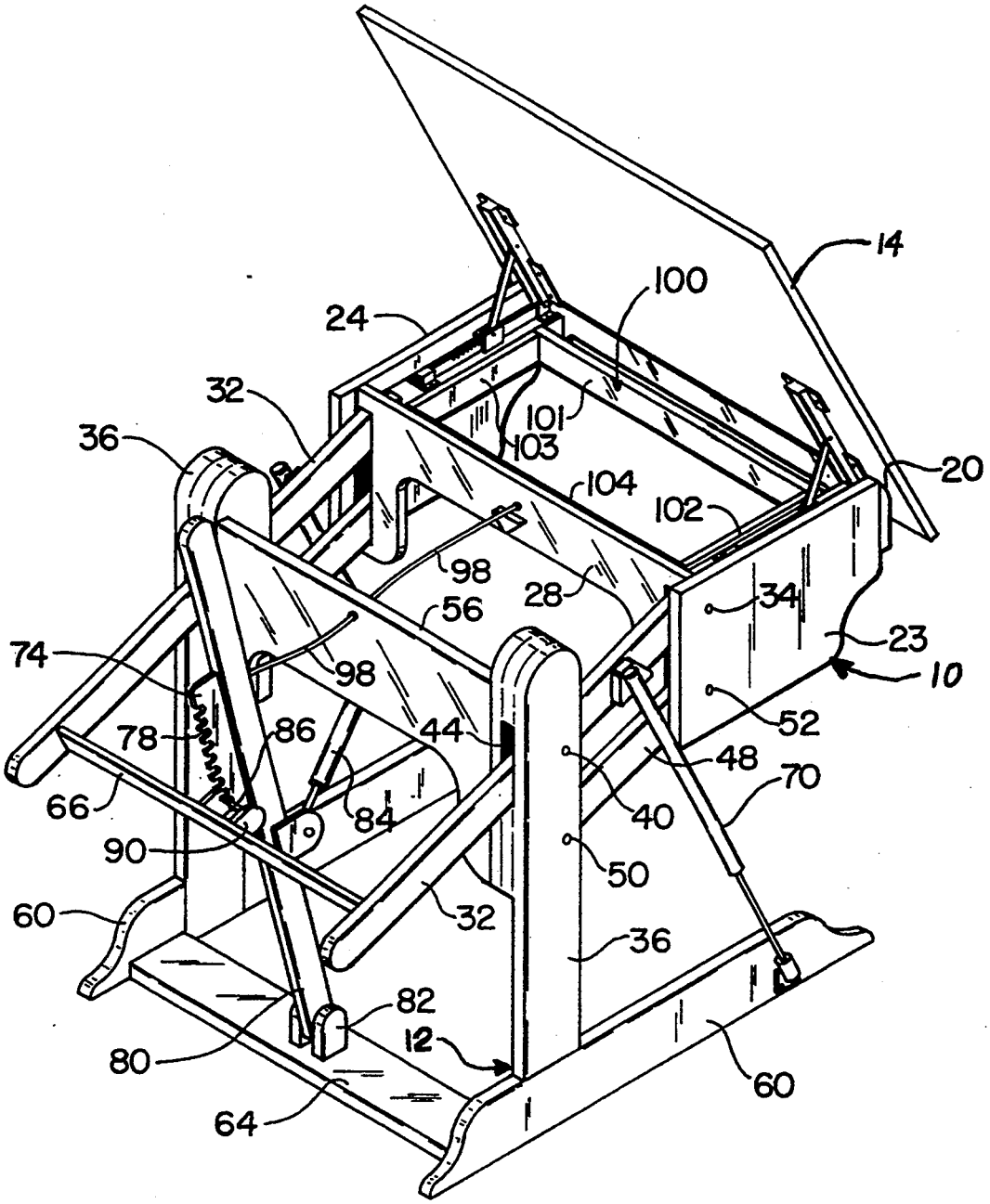
FIG. 7 is a left rear perspective view.

The desk top 14 is preferably adjustable so as to permit the placement of the desk top 14 at a variety of different angles relative to the work surface structure 10. An attachment member 110 can be secured to an underside of the desk top 14 and pivotally mounted about a pivot point 112 to a track member 116 (FIG. 6). The track member 116 is secured to the work surface structure, for example, at the side members 23, 24. A connecting arm 120 can be mounted to the attachment member 110 at a pivot pin 122, and can be mounted to an adjustment piece 118 at a pivot pin 119. The track member 116 has teeth 124 which engage a bar (not shown) in the adjustment piece 118 to secure the adjustment piece 118 in position. The weight of the desk top 14 holds the desk top in position until it is lifted such that the adjustment piece 118 is lifted out of engagement with the teeth 124. The desk top 14 can then be tilted downward to smaller angles of incline (FIG. 5) or lifted upward to greater angles of incline (FIG. 6). Other structure for adjustably securing the angle of the desk top 14 can alternatively be utilized. A pull cord or other structure can be specially adapted to permit adjustment by users who cannot use their hands.

The invention is capable of taking a number of specific forms without departing from the spirit or essential attributes thereof. Alternative structures such as book stands, computer keyboard stands, or various specially-designed tops for particular jobs or crafts, and for particular handicaps, can be substituted for the desk top 14 shown in the drawings. The materials of construction, the relative dimensions, and the structure and positioning of the various components can be changed. Accordingly, reference should be held to the following claims, rather than to the foregoing specification, as indicating the scope of the invention.

We claim:

1. An adjustable work station for the handicapped, comprising:

work surface structure;

support structure, said work surface structure being mounted to said support structure by at least one pivot arm, said work surface structure being provided substantially at an end of said pivot arm distal to the support structure, whereby pivotal movement of said pivot arm will result in substantially vertical movement of said work surface structure;

first biasing structure operable to urge said work surface structure upward in relation to said support structure;

engagement structure for securing said work surface structure in a plurality of positions relative to said support structure;

release structure for disengaging said engagement structure and permitting upward movement of said work surface structure;

said engagement structure further comprising first engagement structure operatively connected to said work surface structure, and second engagement structure operatively connected to said support structure, said first and second engagement structure capable of inter-engaging to prevent upward movement of said work surface structure, said release structure being adapted to move at least one of said first and second engagement structure so as to disengage said engagement structure and to permit upward and downward movement of said work surface structure;

second biasing structure for moving at least one of said engagement structure into engagement with said at least one other engagement structure; and wherein at least one of said engagement structure comprises a latch bar and at least one other of said engagement structure comprises a latch plate, said latch plate having a plurality of recesses capable of engaging said latch bar to retain said work surface structure in a desired position.

2. The work station for the handicapped of claim 1, wherein said latch bar is operatively connected to said work surface structure, and said latch plate is connected to a latch post pivotally mounted to said support structure.

3. The work station for the handicapped of claim 2, wherein said release structure is adapted to move said latch post against the force of said biasing means.

4. The work station for the handicapped of claim 3, wherein said biasing means is a gas cylinder connected between said work surface structure and said latch post.

5. The work station for the handicapped of claim 3, wherein said work surface structure defines front and rear portions, and said release structure comprises a grip bar positioned substantially at said front portion of said work surface structure, said grip bar having a length at least one-half the length of the width of the front portion of said work surface structure.

* * * * *